US008523164B2

(12) United States Patent
Tassinari

(10) Patent No.: US 8,523,164 B2
(45) Date of Patent: Sep. 3, 2013

(54) INSERTER AND A SINGLE-COPY GRIPPER WITH DEEP REACH

(75) Inventor: Peter Roy Tassinari, Kennebunkport, ME (US)

(73) Assignee: Goss International Americas, Inc., Durham, NH (US)

( * ) Notice: Subject to any disclaimer, the term of this patent is extended or adjusted under 35 U.S.C. 154(b) by 40 days.

(21) Appl. No.: 12/639,773

(22) Filed: Dec. 16, 2009

(65) Prior Publication Data

US 2011/0140339 A1 Jun. 16, 2011

(51) Int. Cl.
*B65H 5/30* (2006.01)

(52) U.S. Cl.
USPC ..... 270/52.19; 270/52.14; 270/52.16; 270/52.25; 270/52.23

(58) Field of Classification Search
USPC ..... 270/52.14, 52.16, 52.19, 52.2, 52.23, 270/52.25; 271/82, 85, 204
See application file for complete search history.

(56) References Cited

U.S. PATENT DOCUMENTS 4,723,770 A * 2/1988 Seidel et al. ..... 270/52.2
4,743,005 A * 5/1988 Reist ..... 270/52.22
4,795,418 A 1/1989 Reist
4,840,365 A * 6/1989 Kobler et al. ..... 270/52.19
5,110,116 A * 5/1992 Kobler et al. ..... 271/277
5,269,504 A * 12/1993 Backman ..... 270/52.2
6,082,724 A 7/2000 Kahlig et al.
6,227,588 B1 5/2001 Cassoni
6,367,792 B1 4/2002 Chagnon
6,688,224 B2 2/2004 Herda et al.
6,733,431 B2 5/2004 Dufour
6,752,751 B2 6/2004 Jackson et al.
6,935,234 B2 8/2005 Walczak et al.
2007/0126166 A1 6/2007 Kaya
2007/0161486 A1 7/2007 Richards
2009/0230614 A1 * 9/2009 Meier ..... 271/204

* cited by examiner

*Primary Examiner* — Leslie A Nicholson, III
(74) *Attorney, Agent, or Firm* — Davidson, Davidson & Kappel, LLC

(57) ABSTRACT

An inserter including a pocket for holding an unevenly folded printed product having a fold edge, a first section on a first side of the fold edge and a second section on a second side of the fold edge that is at least 20 percent shorter than the first section is provided. The pocket includes a lower support surface for supporting the fold edge, a first wall for supporting the first section and a second wall for supporting the second section. The first and second walls each have at least one cutout defined therein. The at least one cutout of the second wall includes a lower cutout edge that is less than a length of the second section away from the lower support surface. The inserter also includes a gripper for securely gripping unevenly folded printed product and removing the unevenly folded printed product from the pocket by passing through the at least one cutouts in the first and second walls. A method of inserting an insert into an unevenly folded printed product is also provided.

9 Claims, 9 Drawing Sheets

INSERTER AND A SINGLE-COPY GRIPPER WITH DEEP REACH

The present invention relates generally to post-press devices for the graphics industry and more particularly to transportation of folded printed products.

BACKGROUND

U.S. Pat. Nos. 4,795,418 and 6,227,588 disclose apparatuses for pressing the folded edges of folded paper products which are conveyed by a conveyor and a gripper assembly, respectively.

U.S. Pat. No. 6,082,724, hereby incorporated by reference herein, discloses a variable speed signature collating apparatus.

U.S. Pat. Nos. 6,367,792, 6,688,224, 6,733,431 and 6,752,751, hereby incorporated by reference herein, disclose a copy-guiding cylinder of a folder, a rotary-blade folding unit, a device and method for folding newspapers with flexible inserting position and a folder with multiple-motor drive, respectively.

U.S. Pat. No. 6,935,234, hereby incorporated by reference herein, discloses a lithographic newspaper printing press.

Gripper systems may grip a printed product from a pocket and move the printed product from one location to another. Certain single-copy gripper systems allow for the gripping of an open edge of an off-center cross-folded newspaper section with a minimum of overlap, which is usually less than 1 inch from the high side to the low side. However, some grippers do not provide enough penetration to enable the gripper to grab both the high and the low sides of an unevenly folded section. Conventional gripper systems grab unevenly folded newspaper by the newspaper fold.

SUMMARY OF THE INVENTION

An inserter including a pocket for holding an unevenly folded printed product having a fold edge, a first section on a first side of the fold edge and a second section on a second side of the fold edge that is at least 20 percent shorter than the first section is provided. The pocket includes a lower support surface for supporting the fold edge, a first wall for supporting the first section and a second wall for supporting the second section. The first and second walls each have at least one cutout defined therein. The at least one cutout of the second wall includes a lower cutout edge that is less than a length of the second section away from the lower support surface. The inserter also includes a gripper for securely gripping the unevenly folded printed product and removing the unevenly folded printed product from the pocket by passing through the cutouts in the first and second walls.

A method of inserting an insert into an unevenly folded printed product is also provided. The method includes delivering an unevenly folded printed product having a fold edge, a first section on a first side of the fold edge and a second section on a second side of the fold edge that is at least 20 percent shorter than the first section into a pocket including a bottom portion for supporting the fold edge, a first wall for supporting the first section and a second wall for supporting the second section, the first and second walls each having at least one cutout defined therein and the at least one cutout of the second wall including a bottom that is less than a length of the second section away from the bottom portion; inserting an insert into the unevenly folded printed product; and gripping both the first fold side and the second fold side of the printed product from the pocket by moving arms of a gripper through the cutouts towards the unevenly folded printed product.

A gripper for gripping an unevenly folded printed product is also provided. The gripper includes at least two gripper arms having a reach of at least approximately 8 inches.

An inserter including a pocket and a gripper is also provided. The pocket includes a lower support surface, a first wall and a second wall. The first wall includes at least one first cutout extending from a first top edge of the first wall to a first lower cutout edge formed in an interior of the first wall. The second wall includes at least one second cutout extending from a second top edge of the second wall to a second lower cutout edge formed in an interior of the second wall. The first lower cutout edge is at least a distance equal to half of a height of the first wall from the first top edge. The second lower cutout edge is at least a distance equal to half of a height of the second wall from the second top edge. The gripper is configured to penetrate the at least one first cutout and the at least one second cutout.

BRIEF DESCRIPTION OF THE DRAWINGS

A preferred embodiment of the present invention will be elucidated with reference to the following drawings, in which.

DETAILED DESCRIPTION OF PREFERRED EMBODIMENTS

Figure 1:
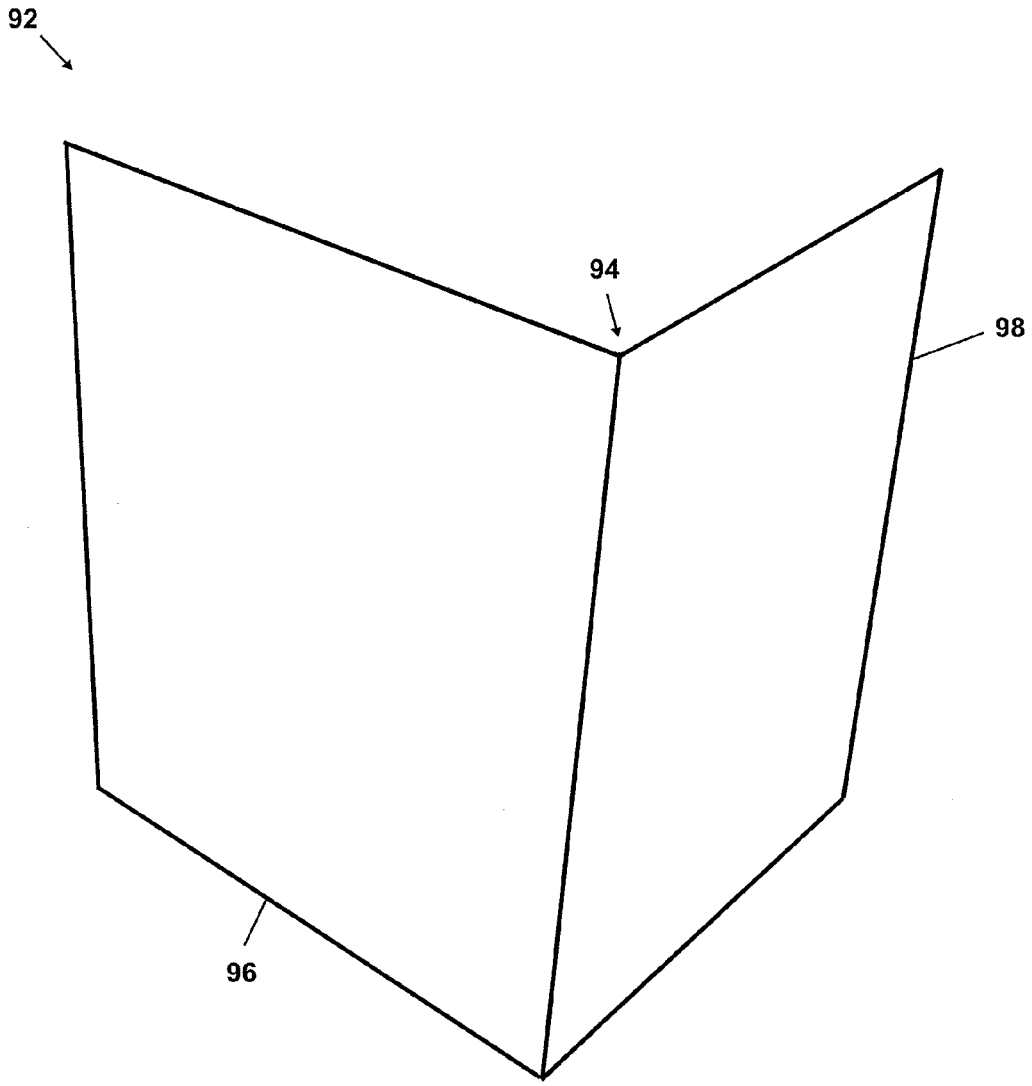
FIGS. 1 to 6 schematically show various exemplary views of an unevenly folded newspaper.

FIG. 1 schematically shows a perspective view of an unevenly folded newspaper 92 having an off-center cross-fold 94, a top section 96 and a bottom section 98. Newspaper 92 may be created using a Berliner format broadsheet newspaper printing press as disclosed in U.S. Patent Application Publication No. US 2007/0161486, which is hereby incorporated by reference herein.

Figure 2:
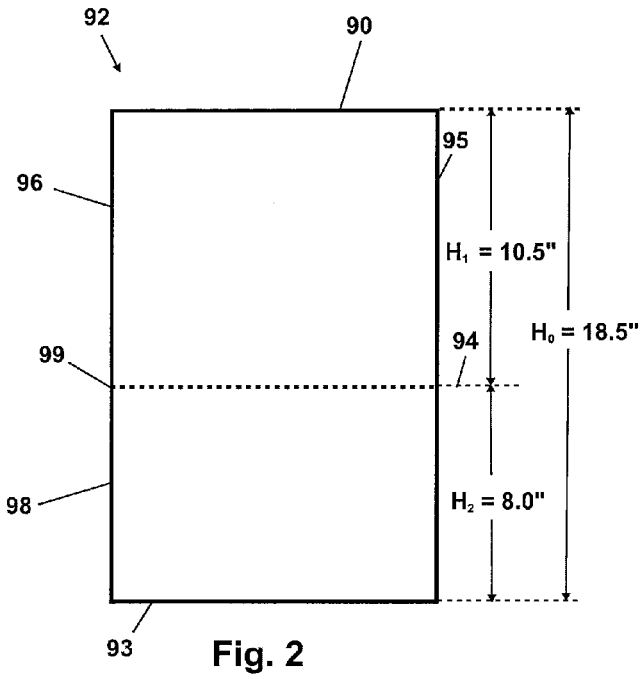

FIG. 2 schematically shows a front view of newspaper 92 unfolded at cross-fold 94. Newspaper 92 has a height $H_0$ and a width $W_1$ when newspaper 92 is half-folded at a half-fold 99, but not cross-folded at cross-fold 94. For example, height $H_0$ may be 18.5 inches and width $W_1$ may be 12.0 inches. The width $W_1$ may also be, for example, between 10.0 and 12.5 inches. Height $H_0$ includes a height $H_1$ above cross-fold 94 corresponding to top section 96 and a height $H_2$ below cross-fold 94 corresponding to bottom section 98. Bottom section 98 is at least 20 percent shorter than top section 96. For example, height $H_1$ may be 10.5 inches, or 56.8% of newspaper height $H_0$ and height $H_2$ may be 8.0 inches or 43.2% of newspaper height $H_0$. Thus, top section 96 is 31.3% larger than bottom section 98. Newspaper 92 is folded at half-fold 99 and has a side edge 95 opposite half-fold 99. Newspaper 92 includes a top edge 90 and a bottom edge 93. Half-fold 99 may have resulted from a cross fold formed by a jaw cylinder in a jaw type folder.

Figure 3:
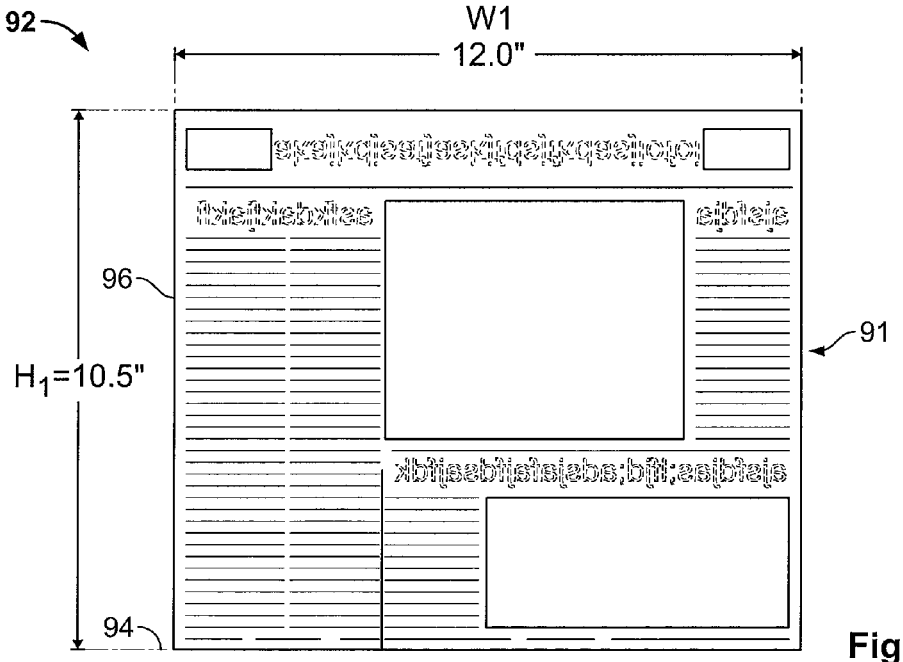

FIG. 3 schematically shows a front view of newspaper 92 folded at cross-fold 94. Bottom section 98 has been folded behind top section 96 of newspaper 92 forming a flap 97 (see FIG. 4) behind a face 91 of newspaper 92.

Figure 4:
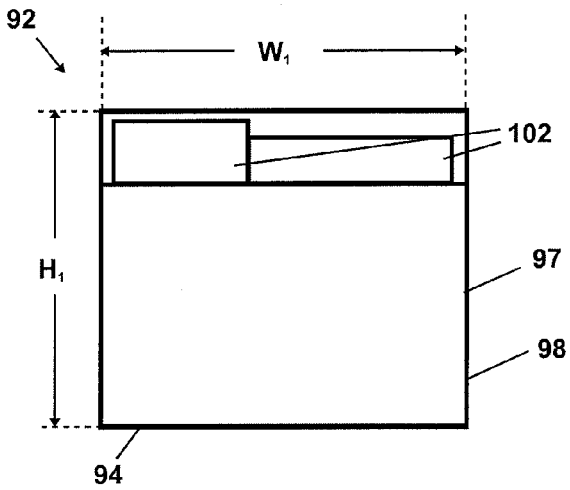

FIG. 4 schematically shows a back view of newspaper 92 folded at cross-fold 94 behind face 91 of newspaper 92 (see FIG. 3). Newspaper 92 may include a plurality of inserts 102, which may be placed inside flap 97. Inserts 102 may be standard sized inserts, for example, 10.5 inches in height and may be greater than, equal to, or less than height $H_1$ of newspaper 92. Inserts 102 may also be a combination of sizes. Inserts 102 may be fed from an inserting device 76 (see FIG. 12) or from a variable speed signature collating apparatus as from the incorporated by reference '724 patent.

Figure 5:
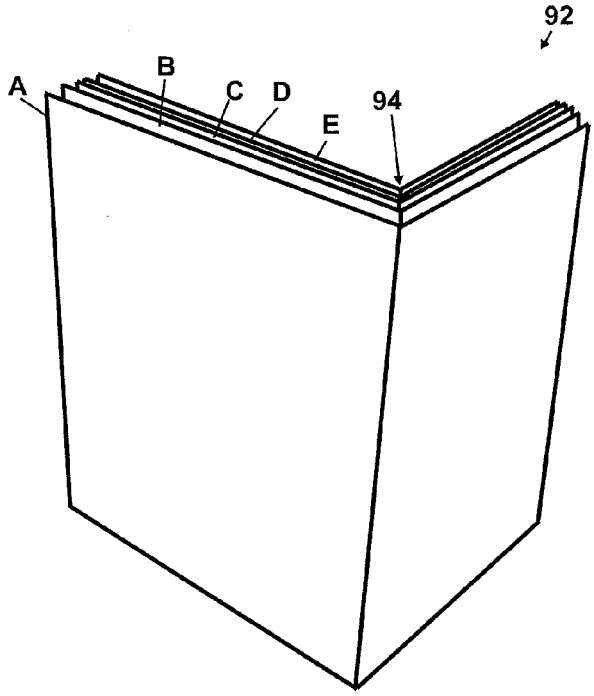

FIG. 5 schematically shows newspaper 92 including multiple sections A, B, C, D, E. Each section A, B, C, D, E may be based on a desired layout of newspaper 92. For example, section A may include news, section B may include sports, section C may include business, section D may include weather and section E may include fashion. Each section A, B, C, D, E may include a plurality of pages or sheets. When newspaper 92 is folded at cross-fold 94 and includes inserts 102, inserts 102 may be placed in-between any of multiple sections A, B, C, D, E or after multiple sections A, B, C, D, E.

Figure 6:
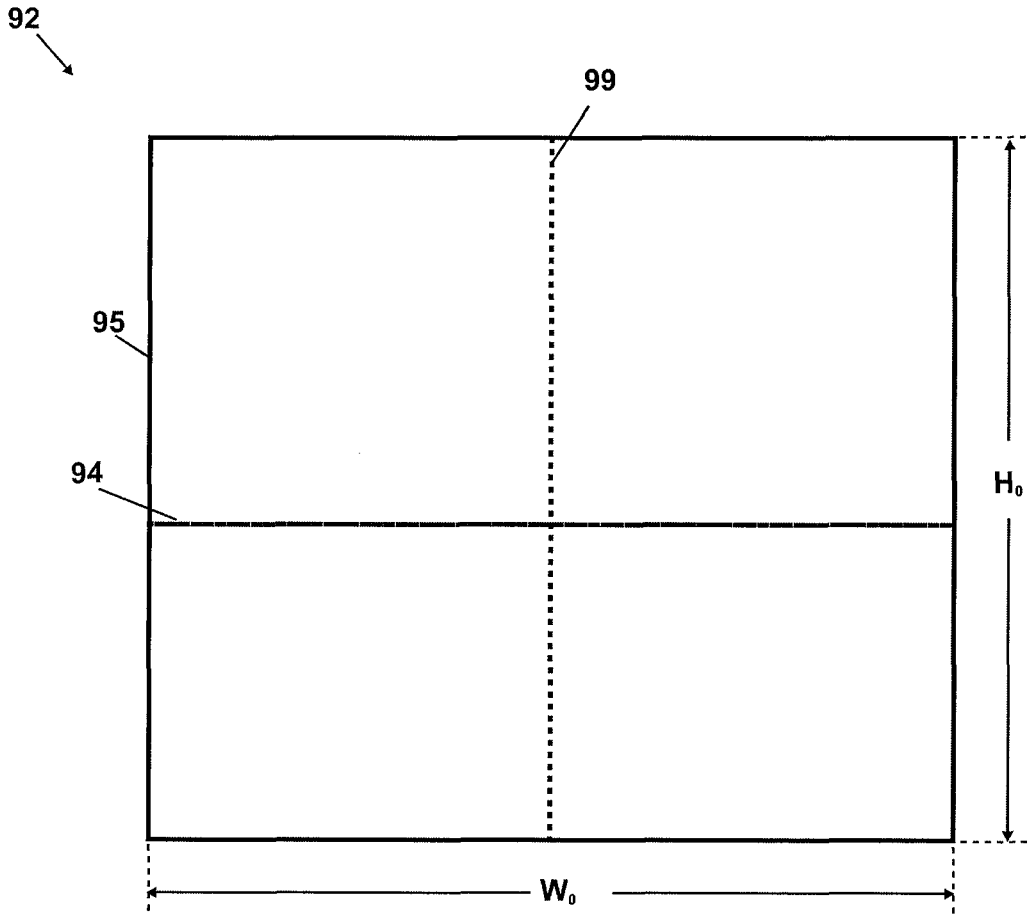

FIG. 6 schematically shows newspaper 92 completely unfolded. When unfolded at half-fold 99, newspaper 92 has an entire width $W_0$. Entire width $W_0$ may be, for example, 24.0 inches. Half-fold 99 may be located in a middle of entire width $W_0$, for example, at 12.0 inches from edge 95 of newspaper 92. Thus, when folded at half-fold 99, newspaper 92 may have a width $W_1$ of, for example, 12 inches, as shown in FIGS. 2 to 4.

Figure 7:
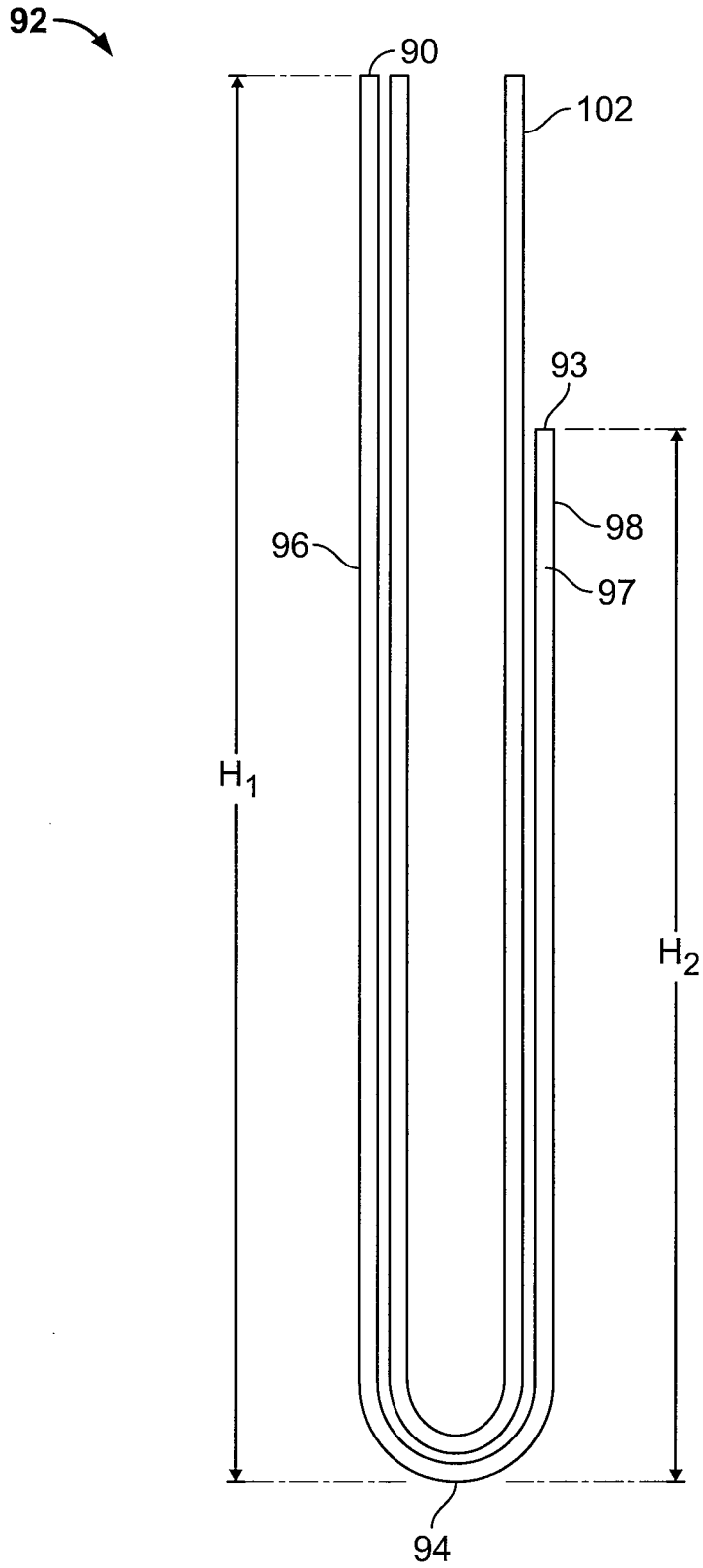
FIG. 7 schematically shows an exemplary side view of the newspaper.

FIG. 7 schematically shows a side view of newspaper 92. Height $H_1$ of top section 96, or face 91, of newspaper 92 is, for example, 10.50 inches and height $H_2$ of bottom section 98, or flap 97, is, for example, 8.0 inches. Insert 102 may have a standard cutoff length of 21.0 inches (insert 102 may be evenly cross-folded with each half being 10.5 inches which is sufficient for insert 102 to fit in within flap 97 without sticking out over top section 96 of newspaper 92). The total height $H_0$ of newspaper 92 is, for example, 18.5 inches. Heights, $H_1$, $H_2$, may be measured from cross-fold 94 to top tip end 90 or from cross-fold 94 to bottom tip end 93 of newspaper 92, respectively (see FIG. 2).

Figure 8:
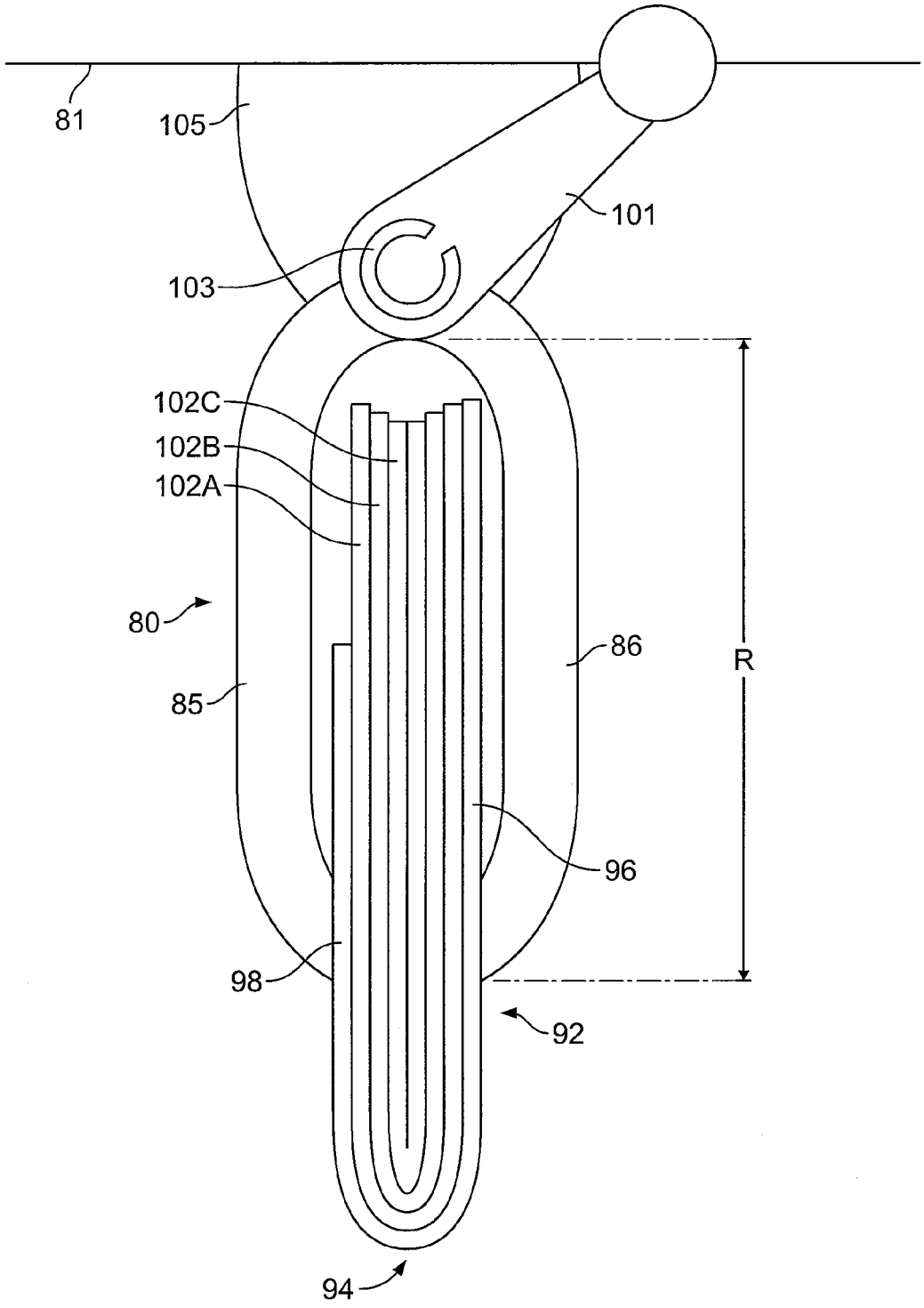
FIG. 8 schematically shows a frontal view of a gripper according to an embodiment of the present invention.

FIG. 8 schematically shows a frontal view of a gripper 80 according to an embodiment of the present invention. Gripper 80 is securely gripping newspaper 92 folded at cross-fold 94 with three inserts 102A, 102B, 102C supported within newspaper 92. Gripper 80 includes movable arms 85, 86 which may be forced into a closed position by a leaf spring 103. Gripper arms 85, 86 may be forced away from each other to release newspaper 92 by actuating a movable actuation arm 101 or by acting on a latch mechanism tripping the gripper to an opened position. Gripper 80 may include a body 105 for coupling gripper 80 to a gripper conveyor 81 or other transportation device (see FIG. 12). It should be noted that gripper 80 may grip newspaper 92 with or without inserts 102A, 102B, 102C. The tips of arms 85, 86 may be coated or tipped with rubber or any other friction material to allow for secure gripping of newspaper 92.

For example, if the height of top section 96 is 10.5 inches and height of bottom section 98 is 8.0 inches, then at least one of arms 85, 86 may have a reach of more than 3.0 inches to allow for reaching over a sufficient distance to securely grip bottom section 98 when newspaper 92 is cross-folded at cross-fold 94. In a preferred embodiment, gripper arms 85, 86 each have a reach R of 6 inches to allow for secure gripping of both sections 96, 98.

Figure 9A:
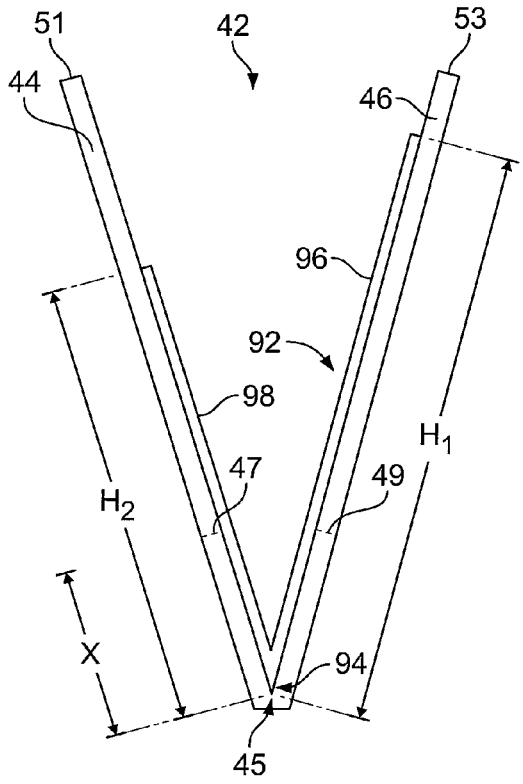
FIGS. 9*a* and 9*b* schematically show frontal and perspective views of a pocket according to an embodiment of the present invention.
Figure 9B:
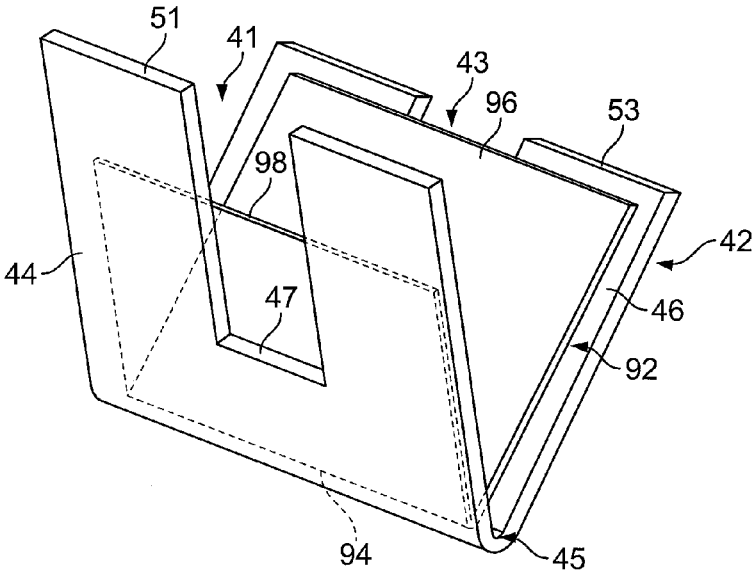

FIGS. 9*a* and 9*b* schematically show frontal and perspective views of a pocket 42 according to an embodiment of the present invention. Pocket 42 may temporarily store and transport newspaper 92, with or without inserts 102 (FIG. 4), along a pocket conveyor 77 (FIG. 12) or other transportation device towards gripper 80 (FIG. 8). In this embodiment, pocket 42 is V-shaped and includes pocket walls 44, 46. In other embodiments, pocket 42 may also be U or W shaped. Pocket 42 may have cutouts 41, 43 formed in walls 44, 46, respectively, extending from top edges 51, 53 of walls 44, 46, respectively, towards a lower support surface 45 of pocket 42. Bottoms of cutouts 41, 43 may be defined by respective lower cutout edges 47, 49.

Pocket 42 may support and transport newspaper 92 with cross-fold 94 resting against lower support surface 45, such that top section 96 rests against wall 46 and bottom section 98 rests against wall 44. Cutouts 41, 43 are contoured to allow movable arms 85, 86 of a gripper 80 (FIG. 8) to penetrate walls 44, 46 and securely grip an open end of newspaper 92. Lower cutout edges 47, 49 are each a distance X from lower support surface 45. In one preferred embodiment, lower cutout edges 47, 49 are at least halfway down respective walls 44, 46, such that distance X is less than or equal to half of the distance between each of top edges 51, 53 and lower support surface 45. In another preferred embodiment, distance X is less than height $H_2$ of bottom section 98 so that cutouts 41, 43 allow respective movable arms 85, 86 (FIG. 8) to grip both top section 96 and bottom section 98 and remove newspaper 92 from pocket 42.

Figure 10:
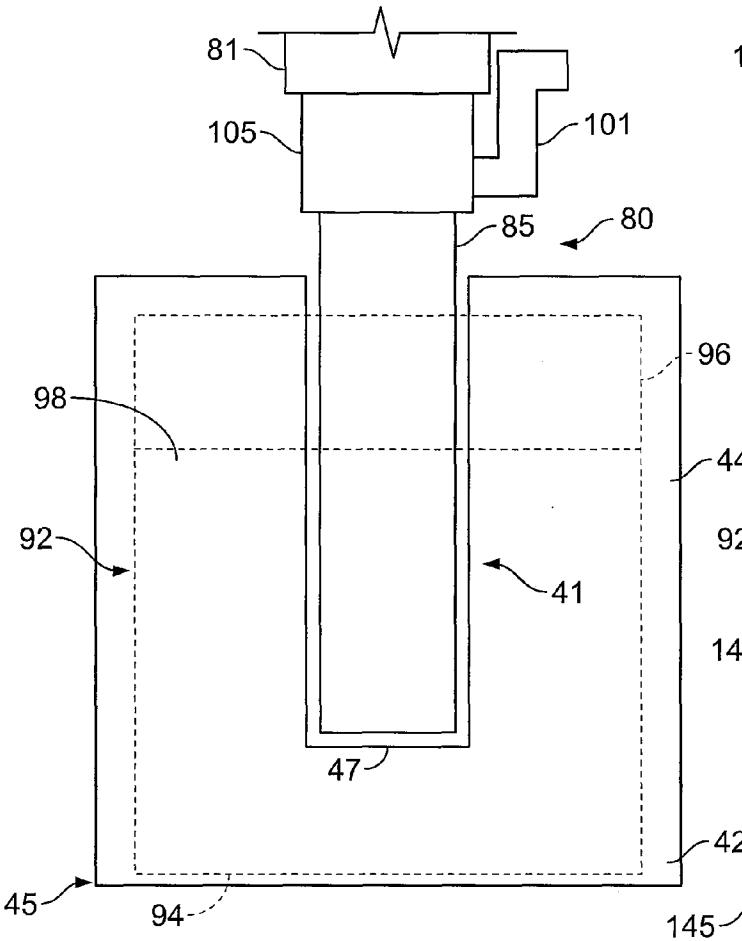
FIG. 10 schematically shows the gripper shown in FIG. 8 reaching through cutouts in the pocket shown in FIGS. 9*a* and 9*b* to grip the unevenly folded newspaper.

FIG. 10 schematically shows gripper 80 reaching through cutouts 41, 43 (FIG. 9*b*) to grip unevenly folded newspaper 92 from pocket 42. Newspaper 92 is folded at cross-fold 94 to include top section 96 and bottom section 98. Arm 85 may reach through cutout 41 to contact bottom section 98 as arm 86 (FIG. 8) reaches through cutout 43 (FIG. 9*b*) to contact top section 96. Gripper arms 85, 86 (FIG. 8) may be attached to body 105, which is coupled to gripper conveyor 81. Gripper arms 85, 86 may be forced away from each other by the actuation of actuation arm 101 (or the fore mentioned trip mechanism) and may be closed by the force of spring 103 (FIG. 8) or by actuation of actuation arm 101 to grip newspaper 92.

Figure 11:
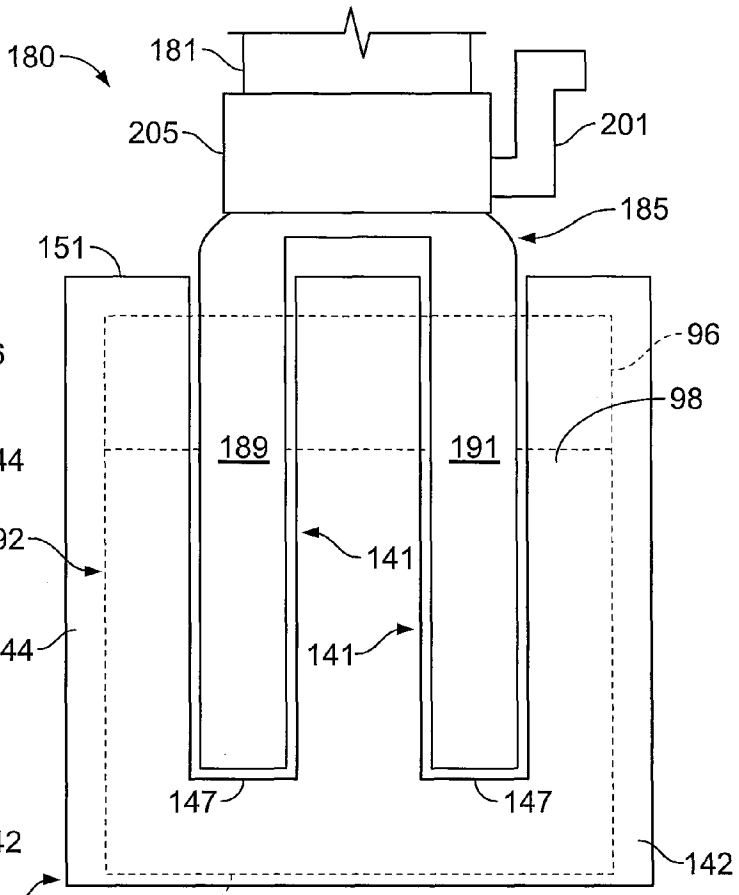
FIG. 11 schematically shows a gripper and pocket according to a further embodiment of the present invention.

FIG. 11 schematically shows a gripper 180 and a pocket 142 according to another preferred embodiment of the present invention. Gripper 180 includes a first arm 185 that includes to two gripping elements 189, 191 and a second arm opposite first arm 185 that also includes two gripping elements. Pocket 142 includes a first wall 144 and a second wall connected to first wall 144 at a lower support surface 145 of pocket 142. First wall 144 includes two cutouts 141 contoured to allow gripping elements 189, 191 of first arm 185 to penetrate through first wall 144 and contact bottom section 98 of newspaper 92. The second wall also includes two cutouts contoured to allow the two gripping elements of the second arm to penetrate the second wall and contact top section 96 of newspaper 92. Cutouts 141 extend from a top edge 151 of walls 144, 146, respectively, towards lower support surface 145 inside of pocket 142. Bottoms of cutouts 141 may be defined by respective lower cutout edges 147 in wall 144.

With cross-fold 94 of newspaper 92 resting on lower support surface 145, gripper 180 may grip both top section 96 and bottom section 98 to remove newspaper 92 from pocket 142.

First gripper arm 185 and the second gripper arm may be attached to a body 205, which may be coupled to a gripper conveyor 181. First gripper arm 185 and the second gripper arm may be forced away from each other by the actuation of an actuation arm 201 (or a trip mechanism) and may be closed by the force of a spring or by actuation of actuation arm 201 to grip newspaper 92.

Figure 12:
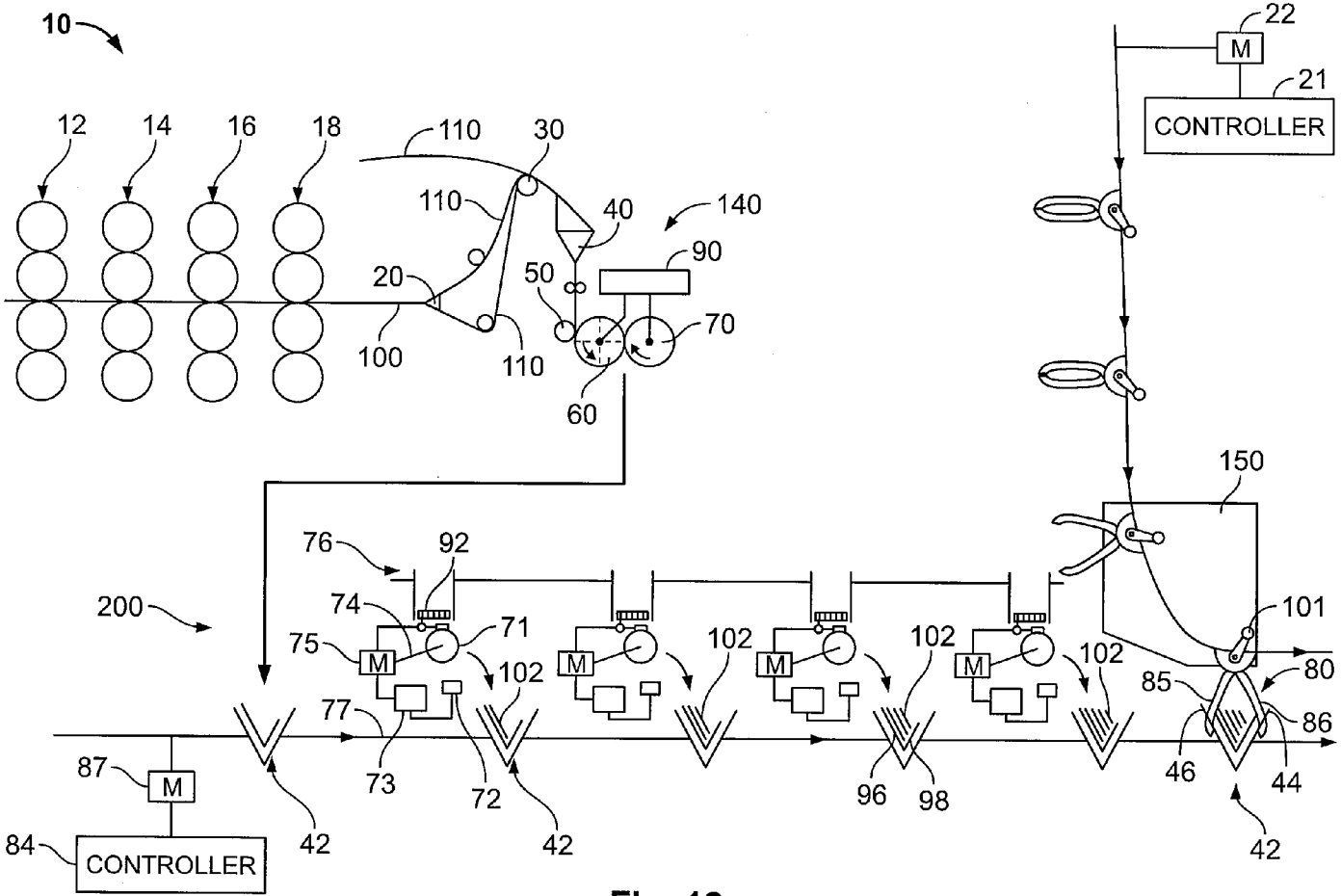
FIG. 12 schematically shows a printing press operating in conjunction with an inserter according to an embodiment of the present invention.

FIG. 12 schematically shows a printing press 10 operating in conjunction with an inserter 200 according to an embodiment of the present invention. Printing press 10 may include a printing section with printing units 12, 14, 16, 18 printing on a web 100. Printing units may be, for example, offset, lithographic, perfecting printing units each printing a different color ink, for example, cyan, magenta, yellow and black.

Web 100 may be slit by a slitter 20 into ribbons 110, which are recombined, potentially with other ribbons 110, at a roller 30. Ribbons 110 of web 100 then enter a folder 140 and pass to a former board 40 for folding ribbons 110 longitudinally. A cross cutter 50 of folder 140 then cuts ribbons 110 into individual newspapers, for example, a broadsheet newspaper, which are gripped at a lead edge by cylinder 60. Cylinder 60 has pins that selectively articulate to pull the newspaper for cross-folding, or retain the pages to collect with other pages. Newspapers 92 are then tucked and cross-folded into a folding cylinder, for example, jaw cylinder 70. After folding, newspapers 92 are released to, for example, a fan wheel, a belt conveyor and a press gripper pick-up, then delivered to inserter 200. The fan wheel and belt conveyor are shown for example in U.S. Pat. No. 6,733,341, hereby incorporated by reference herein.

A controller 90 may set the phasing between the pins and tuckers of tucker cylinder 60, and control the phasing of jaws of jaw cylinder 70, so that a cross-fold distance may be set. Owing to the phasing control, cross-fold 94 may be set so top section 98 of newspaper 92 has a height of, for example, 10.5 inches. The cross-fold 94 may allow some newspapers to receive standard inserts 102, for example, by providing a longer side. Folder spiders may also provide this phasing. The cross-fold 94 may be located 45% or less from an edge of the newspaper or 55% or more from the edge of the newspaper. The off-center cross-fold advantageously permits smaller format newspapers to receive standard inserts for example by providing a longer side. Alternatively, the cross-fold position may be set mechanically and/or manually.

Inserter 200 may include one or more inserting devices 76 located along the path of moving pocket conveyor 77. Inserting devices 76 may insert jacket sections, additional newspaper sections or inserts 102 into newspapers 92 in pockets 42 once pockets 42 reach a predetermined feeding position.

Inserting device 76 may include hoppers, a feed drum 71. The feed drum may be coupled to motor 75 via a feed drum drive shaft 74. Motor 75 may be coupled to a controller 73 for controlling the speed of feed drum 71.

Inserting device 76 may include a pocket detection device, for example, a pocket sensor 72. Pocket sensor 72 may sense the proximity of pocket 42 and upon movement of a pocket 42 into a predetermined position relative to one of inserting devices 76, pocket sensor 72 may output an alert signal to controller 73 so newspapers 92 or inserts 102 are deposited into pockets 42 via spinning movement of feed drum 71. Pocket sensor 72 may be coupled to controller 73.

Inserter 200 includes a plurality of grippers 80 conveyed by gripper conveyor 81. Controller 21 may control the speed of gripper conveyor 81 via a motor drive 22 coupled to gripper conveyor 81. The movement of pocket conveyor 77 may be synchronized with the movement of gripper conveyor 81. A controller 84 may control the speed of pocket conveyor 77 via a motor drive 87 coupled to pocket conveyor 77.

As one of grippers 80 approaches one of pockets 42 at a gripper pick-up station, arms 85, 86 of gripper 80 may be actuated into an open position by an actuation device 150, which may include a movable cam. Arms 85, 86 are separated from one another a sufficient distance to allow gripper arms 85, 86 to extend outside of walls 44, 46 of pocket 42 as gripper 80 approaches pocket 42. Actuation arm 101 may then be released and spring 103 may cause arms 85, 86 to move towards each other or arm 101 may be acted upon by a cam to close and latch the gripper 80. Arms 85, 86 then may pass through cut-outs 43, 41 in walls 46, 44, respectively, to grip newspaper 92 and remove newspaper 92 from pocket 42. The grip of arms 85, 86 is secure enough to grip newspaper 92 (with or without sections A, B, C, D, E or insert 102) as newspaper 92 leaves pocket 42. Gripper 80, via gripper conveyor 81, may the transport gripped newspaper 92 to receiving conveyors or other locations for further processing.

Gripper 80 may securely grip any unevenly folded product with an off-center cross-fold. For example, gripper 80 may securely grip unevenly folded newspapers with an off-center cross-fold printed in any newspaper format such as, for example, a broadsheet format, a Berliner format or a tabloid/compact format with or without inserts 102 or sections A, B, C, D, E.

For example, in a newspaper printed in the Berliner format, where a newspaper height is 18.5 inches (without a cross-fold) and a newspaper width is between for example 10.0 and 17.0 inches (former folded), bottom section 98 formed via off-center cross-fold 94 may be 8.0 inches and top section 96 may be 10.5 inches. Insert 102 may be inserted in the resulting 8.0 inch flap that may be formed. At least one of arms 85, 86 may have a reach of more than 3.0 inches deep in order to allow for reaching over the 2.5 inch displacement and securely gripping newspaper 92.

It should also be noted that newspaper 92 may be printed and folded with an off-center cross-fold in such a way that top section 96 section may appear with the headline, with, for example, insert 102 behind. However, bottom section 98 may appear with the headline, i.e. the top section 96 may be at the rear and may provide, for example, advertising space.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A method of inserting an insert into an unevenly folded printed product comprising:

delivering an unevenly folded printed product having a fold edge, a first section on a first side of the fold edge and a second section on a second side of the fold edge that is at least 20 percent shorter than the first section into a pocket including a bottom portion for supporting the fold edge, a first wall for supporting the first section and a second wall for supporting the second section, the first and second walls each having at least one cutout defined therein and the at least one cutout of the second wall including a bottom that is located at a height of 50% or less of a height of the second wall from the bottom portion;

inserting an insert into the unevenly folded printed product; and gripping both the first fold side and the second fold side of the printed product from the pocket by moving arms of a gripper through the cutouts towards the unevenly folded printed product.

2. The method recited in claim 1 wherein the printed product is a newspaper that is unevenly cross-folded.

3. The method recited in claim 1 wherein the gripper includes at least one first gripper arm and at least one second gripper arm and the gripping step includes passing the at least one first gripper arm through the at least one cutout in the first wall and passing the at least one second gripper arm through the at least one cutout in the second wall.

4. The method recited in claim 3 wherein the at least one first gripper arm and the at least one second gripper arm each have a reach longer than a difference in a length of the first section and the length of the second section.

5. The method recited in claim 1 further comprising conveying the pocket away from an inserting device after the inserting step and before the gripping step.

6. The method recited in claim 1 further comprising conveying the gripper and the unevenly folded printed product held by the gripper away from the pocket after the gripping step.

7. The method recited in claim 1 wherein a height of the first section is about 10.5 inches and a height of the second section is about 8.0 inches.

8. The method recited in claim 1 wherein the first section is at least 20 percent longer than the second section and the gripper is configured to securely grip the first section and the second section of the unevenly folded printed product held by the pocket.

9. The method recited in claim 1 wherein the gripper has a reach of greater than 3 inches and is configured to securely grip the first section and the second section of the unevenly folded printed product held by the pocket.

* * * * *